US006418689B1

(12) United States Patent
Hacquard et al.

(10) Patent No.: US 6,418,689 B1
(45) Date of Patent: Jul. 16, 2002

(54) REMOVABLE WALL SYSTEM

(75) Inventors: Pierre Hacquard, Strasbourg; Guy Fabbro, Saverne, both of (FR)

(73) Assignee: Someta, Sarre Union Cedex (FR)

( * ) Notice: Subject to any disclaimer, the term of this patent is extended or adjusted under 35 U.S.C. 154(b) by 0 days.

(21) Appl. No.: 09/356,561

(22) Filed: Jul. 19, 1999

(30) Foreign Application Priority Data

Jul. 21, 1998 (FR) ..... 98 09289

(51) Int. Cl.[7] ..... E04B 9/00

(52) U.S. Cl. ..... 52/474; 52/238.1; 52/481.1; 52/481.2

(58) Field of Search ..... 52/474 B, 238.1, 52/481.1, 481.2

(56) References Cited

U.S. PATENT DOCUMENTS 5,060,434 A 10/1991 Allison
5,377,466 A * 1/1995 Insalaco et al. ..... 52/238
5,787,651 A * 8/1998 Horn et al. ..... 52/144

FOREIGN PATENT DOCUMENTS

| | | |
|---|---|---|
| EP | 0 792 975 | 9/1997 |
| WO | 87 01751 A | 3/1987 |

* cited by examiner

*Primary Examiner*—Beth A. Stephan
(74) *Attorney, Agent, or Firm*—Smith, Gambrell & Russell, LLP

(57) ABSTRACT

Removal wall system of the type comprising at least one panel and at least one panel fixing stud 1. The stud is a hollow section having a rectangular cross section provided with two pairs of symmetrical ribs 6 to 9 disposed at the extremities of the longer sides 2, 3 and extending parallel to the shorter sides 4, 5, panel fixing means being formed integrally with the section.

20 Claims, 3 Drawing Sheets

REMOVABLE WALL SYSTEM

FIELD OF INVENTION

The present invention concerns the field of construction, in particular of office premises or any professional premises, and wall systems or the like for such offices or professional premises.

BACKGROUND OF THE INVENTION

Such premises are at present usually equipped with walls of the so-called "drywall" or "industrialised" type. There are two major types of wall in this category: on the one hand, non-demountable walls which are generally made of plaster and which must be demolished to alter the layout of the premises; on the other hand, demountable or removable walls. Removability is the preferred way of altering the layout of premises, a removable wall being re-usable as such without any cutting, drilling or other adaption operation.

This latter type of wall system includes "framework and cladding" systems: the panels are attached by various fasteners to either side of a framework generally made up of studs and crossbeams.

The panels can of course be made of metal (steel, stainless steel, aluminum, etc.), wood, plasterboard, glazing of any kind, etc.

Walls with a framework are very important in the field of removable walls because they are widely adaptable to suit all architectural forms and all kinds of technical constraints and regulations.

In traditional framework type removable wall systems the panels are fixed to the framework by means of screws, staples, angle blocks, clips, possibly elastic clips, etc.

It follows that a large number of components are required for assembly, making it expensive and labour-intensive and leading to risk of mistakes, noise and even unreliable fixings.

SUMMARY OF INVENTION

The aims of the present invention are to remedy the drawbacks of the systems referred to hereinabove and to propose a removable wall system that is economic to manufacture, simple to install and demount and comprises a small number of components.

The removable wall system in accordance with the invention is of the type comprising at least one panel and at least one panel fixing stud, the stud being a hollow section with a rectangular cross section provided with two pairs of symmetrical ribs disposed at the extremities of the longer sides and extending parallel to the shorter sides, panel fixing means being formed integrally with the section, characterised in that at least one hook is formed in a longer side, the hook being set back relative to the ribs.

This set-back position reduces the risk of injuring installation operatives, damaging the hooks during handling connected with installing the wall and damaging other objects that may be in contact with the studs.

In one embodiment of the invention, the hook is formed in the metal plate of the longer side.

The hook is advantageously formed by cutting-stamping.

In one embodiment of the invention, the hook projects from the longer side.

The panel can therefore be fixed directly to the stud.

In one embodiment of the invention, the longer side of the stud is parallel to the outside surface of the panel. At least one insulating member can be disposed in contact with the shorter side of the stud. This insulation or fire-break member can be supported by an inside face of the panel. The panel can have an end portion forming a lip parallel to the longer side and cooperating with the fixing means.

The invention also consists in a removable wall system of the type comprising at least one panel and at least one panel fixing stud, the stud being a hollow section with a rectangular cross section, characterised in that the stud has two symmetrical ribs each at one extremity of a longer side and extending parallel to a shorter side, panel fixing means being formed integrally with the section, at least one hook being formed in a longer side and the hook being set back relative to the adjacent rib. A stud of the above kind is similar to a half-stud of the type described above.

In one embodiment of the invention, the stud has a final side parallel to the shorter side and partly closed by two rims, each originating from one extremity of a longer side.

The invention provides a wall whose panels are fixed directly to the studs with guaranteed mechanical strength, in particular fire resistance, and can be demounted easily and without risk of damaging them.

The invention dispenses with all intermediate parts for attaching the panel between the stud and the panel. This reduces the number of parts that have to be assembled with reduces the cost of manufacture and makes installation very fast, cheap and quiet. Demounting and re-installing a wall of the above kind are easy and are not subject to any limitations. The disposition of the hooks, projecting relative to the longer sides but set back relative to the ribs, prevents the fixing hooks projecting relative to the periphery of the cross section of the stud, which is safer for the operatives and greatly facilitates storing and stacking the studs in any environment.

By punching-stamping the necessary hooks into the studs, the invention alleviates the drawbacks referred to above by adequately integrating the system for fixing the panels into the studs during their manufacture.

The tubular H-shaped profile of the stud is designed for great dimensional stability, both statically and dynamically during construction. It also prevents the fixing hooks protruding relative to the bare profile, greatly facilitating handling and storage and making them very safe for operatives.

The system also incorporates all the usual fixing facilities without additional works or adaptation.

BRIEF DESCRIPTION OF THE DRAWINGS

The present invention will be better understood and other advantages will become apparent on reading the detailed description of one embodiment given by way of non-limiting example and illustrated by the accompanying drawings, in which.

DESCRIPTION OF THE PREFERRED EMBODIMENTS

Figure 1:
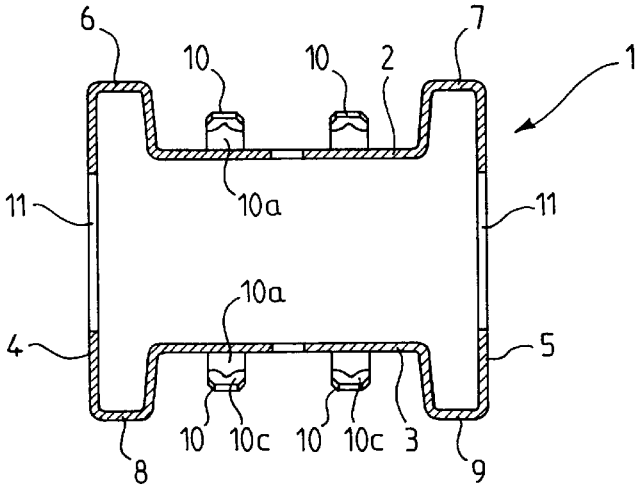
FIG. 1 is a view in cross section of a wall stud in accordance with the invention.

As shown in the figures, the stud 1 is made from a hollow metal, for example sheet steel, section. The stud 1 has generally rectangular cross section with longer sides 2 and 3 and shorter sides 4 and 5, parallel in pairs. Longitudinal ribs 6 to 9 are provided at the extremities of each longer side 2, 3 and are flush with the shorter sides 4 and 5. The stud is symmetrical about the plane parallel to the longer sides and equidistant from them and about a plane parallel to the shorter sides 4 and 5 and equidistant from them. The longer side 2 is therefore set back relative to the ribs 6 and 7 and the longer side 3 is likewise set back relative to the ribs 8 and 9.

Hooks 10 are permanently fixed to each of the longer sides 2 and 3. The hooks 10 can be welded to the stud 1, for example. However, it is preferable to form the hooks 10 from the material of the longer sides 2 and 3, for example by punching them, which is an economic way of fabricating the studs 1.

FIG. 1 shows in particular that two hooks 10 are provided on each longer side 2, 3 at a given height, one for cooperating with a panel on the same side as the rib 6 and the other for cooperating with a panel on the same side as the rib 7.

Each hook 10 has a portion 10*a* parallel to a plane transverse to the stud 1 and joined directly to a longer side 2, 3. The hook 10 is extended by a portion 10*b* parallel to the longer side 2, 3 from which the hook 10 originates and directed upwards. The hook 10 terminates at an end 10*c* that is curved slightly outwards. The portion 10*a* offsets the hook 10 sufficiently from the longer side 2, 3 from which it originates to allow the insertion of a panel portion between the parallel portion 10*b* and said longer side 2, 3.

However, the hooks 10 do not project beyond the ribs 6 and 7, 8 and 9, which protects said hooks 10 against unsuitable handling in the factory, during installation or during successive demounting and reinstallation cycles. The studs 1 can therefore be stacked up without risk of deforming any of the hooks 10. The protection provided by the ribs 6 and 7, 8 and 9, which project relative to the hooks 10, including relative to their ends 10*c*, prevents the hooks 10 catching on other items in the premises where they are being installed or modified. Personnel having to handle the studs 1 or work near them are also protected against all risk of injury.

The stud 1 is also provided with various holes for installing angle blocks, clips or screws, not shown. For example, oval holes 11 and square holes 12 can be provided on the shorter sides 4 and 5. In addition to easy passage of electrical, telephone, computer, etc. cables, the oval holes 11 allow the direct attachment, without intermediate parts, of slotted members, for example crossmembers 45 disposed between two studs 1 in the interior space between two panels. The crossmembers 45 can support other members or stiffener means between two studs 1.

Circular holes 13 of small diameter can equally be provided. The longer sides 2 and 3 can incorporate elongate rectangular slots 14, V-shaped holes 15 and circular holes 16 of small diameter.

Figure 2:
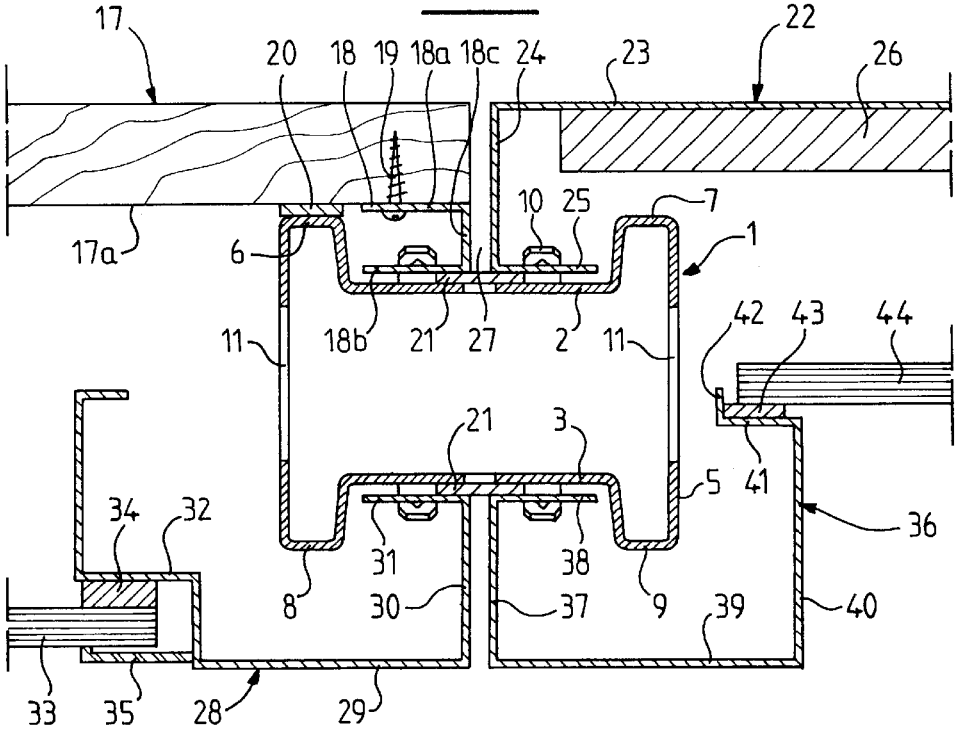
FIG. 2, which is similar to FIG. 1, shows the cooperation of a stud of the above kind with various types of panel.
Figure 3:
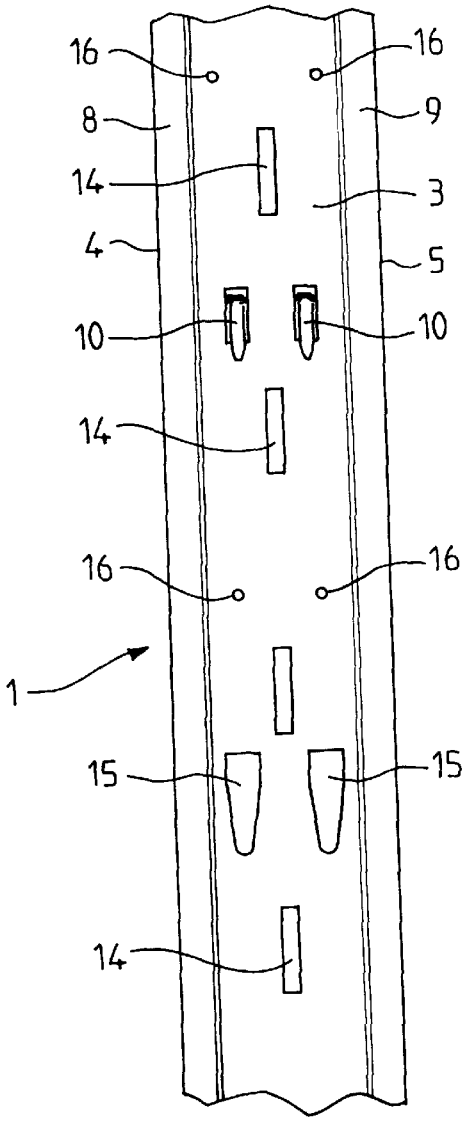
FIG. 3 is a front elevation view of a wall stud in accordance with the invention.
Figure 4:
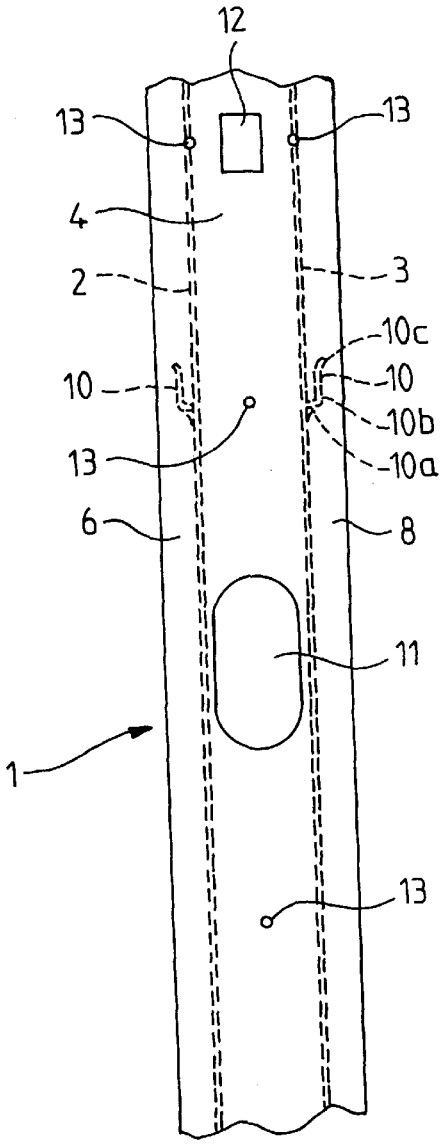
FIG. 4 is a side elevation view of a all stud in accordance with the invention.

FIG. 2 shows the attachment of various types of panel to a stud 1. The panel 17 is made of wood or plaster and is on the same side as the rib 6. A U-shaped attachment member 18 is attached to the panel 17 by means of screws 19 when the panel is manufactured in the factory.

The attachment member 18 has a branch 18*a* parallel to and in contact with the face 17*a* of the panel 17 on the same side as the panel 1 and a branch 18*b* parallel to the branch 18*a* and to the longer side 2 and between the hook 10 and said longer side 2, near the rib 6. The attachment member 18 is completed by a branch 18*c* perpendicular to the branches 18*a* and 18*b* and joining them together. To complete the attachment of the panel 17 to the stud 1, elastic packing 20 is disposed between the rib 6 and the face 17*a* of the panel 17 to ensure good contact between these two members. The packing 20 can be fixed, for example glued, to the surface 17*a* in the factory. The packing 20 can be made of foam and enables stable and precise positioning of the panel 17 and provides a good air seal and acoustic and thermal insulation. Elastic packing 21 between the branch 18*b* of the attachment member 18 and the longer side 2 of the stud 1 assures precise and stable positioning of the panel 17 relative to the stud 1. The packing 21 can be common to another panel and has the same advantages as the packing 20.

The panel 22 comprises a thin metal plate 23 whose extremity of the same side as the rib 7 is bent at a right angle towards the longer side 2 to form a rim 24 parallel to the shorter sides 4 and 5. The free extremity of the rim 24 is itself bent at a right angle to form an extremity 25 between the hook 10 and the longer side 2 near the rib 7. The extremity 25 is in contact with the packing 21. The panel 22 is completed by an insulative member 26, of the fire-break type, for example, fixed to the metal plate 23 on the same side as the rib 7. The two panels 17 and 22 therefore have coplanat and adjacent outside surfaces, there being only a small gap 27 between the two panels 17 and 22. For aesthetic or functional reasons, this gap can be varied by virtue of the lateral clearance allowed in punching the attachments of the panel and the possibility of varying the width of the panel itself. The gap 27 can be eliminated to provide an "edge to edge" arrangement. The maximum width permitted by the system is approximately 10 mm.

This feature of the system allows it to be adapted to suit many kinds of architecture and decoration. It also provides for adaptation to functional requirements by enabling the fitting of extruded seals (silicon mastic seals, for example) or removable elastic seals if additional or total sealing is required.

A panel 28 mounted near the rib 8 comprises a metal section 29 which has an edge 30 and an extremity 31 similar to the edges 24 and the extremity 25 of the panel 22. The section 29 has a staggered portion 32 on which a plane member 33 is mounted by means of packing 34 and a synthetic material seal 35.

A panel 36 mounted near the rib 9 has a rim 37 and an extremity 38 similar to those of the panel 22. Starting from the rim 37, the panel 36 comprises a wall 39 parallel to and coplanar with the adjacent panel 28. The wall 39 is bent inwards at a right angle to form a wall 40 parallel to and near the shorter sides 5. The wall 40 is extended by a rim 41 at right angles to it and extending towards the shorter side 5, its extremity 42 being again bent at a right angle towards the rib 7 and parallel to the shorter sides 5.

Packing 43 in contact with the rim 41 and the extremity 42 receives a plane member 44 similar to the plane member 33 of the panel 28, but set back relative to the plane member 33, which significantly reduces the thickness of the wall formed by the stud 1 and the panels that it supports, making a greater area and volume available in the premises in which the wall is installed.

The four types of panel 17, 22, 28 and 36 described above are given by way of example. The stud 1 could be used with other types of panel having either an inwardly curved extremity parallel to the longer sides 2, 3 or a different type of extremity forming a hook or lug and adapted to cooperate with a hook 10.

Figure 5:
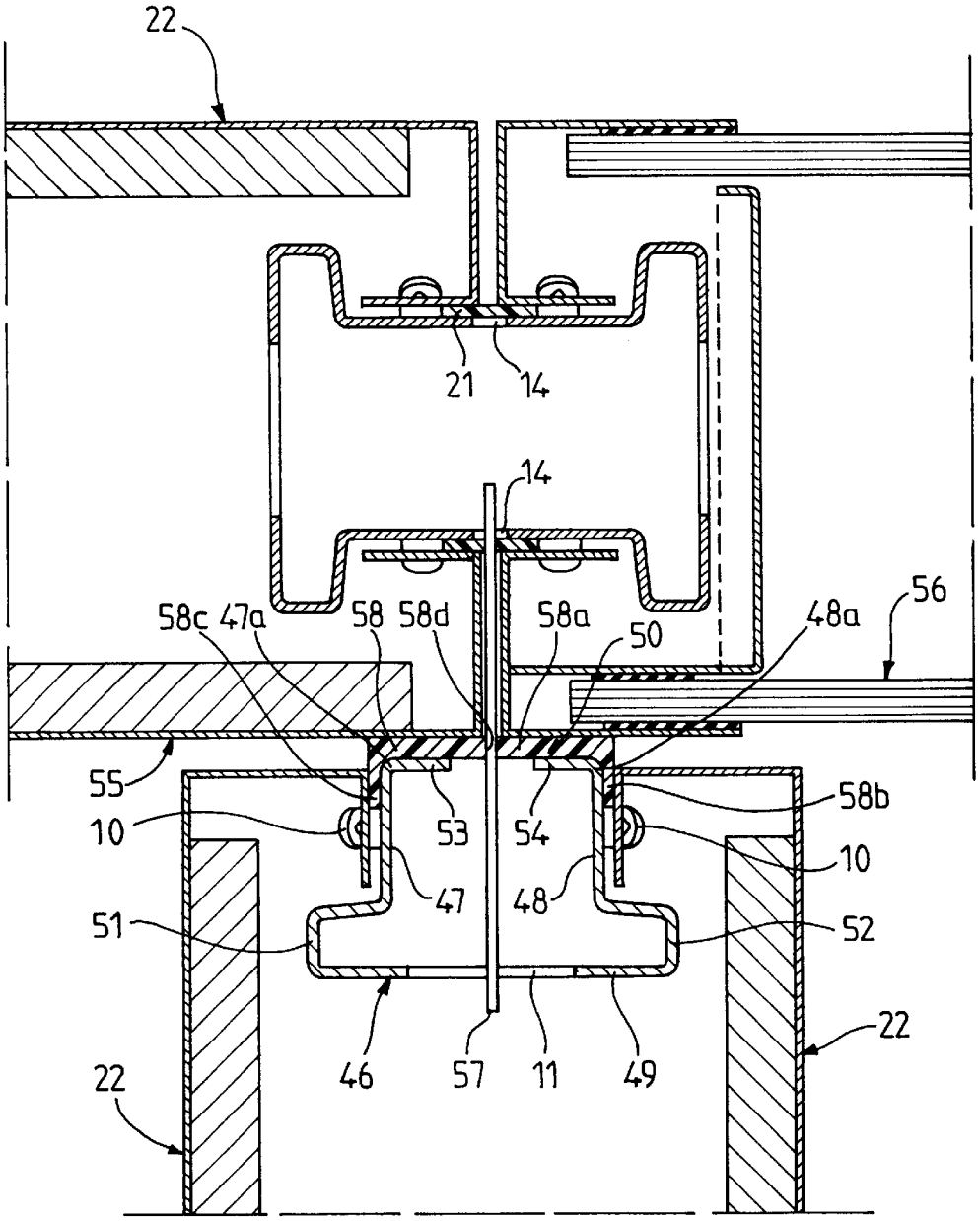
FIG. 5 is a view in cross section of a variant of the wall stud in accordance with the invention.

In the embodiment shown in FIG. 5, the half-stud 46 is made from a hollow metal, for example sheet steel, section.

The stud 46 has a section corresponding to that of a stud 1 cut in half in the middle of the longer sides 2 and 3 with a stiffener rim 53, 54 at the cut extremity 47*a*, 48*a* of each longer half-side 47, 48, oriented inwards and parallel to the shorter side 49.

In other words, the half-stud 46 is generally rectangular with parallel longer half-sides 47, 48, a shorter side 49 perpendicular to the longer half-sides 47, 48 and a final side 50 at the extremities 47*a*, 48*a* of the longer half-sides 47, 48. The final side 50 is parallel to the shorter side 49 and is partly closed by the stiffener rims 53, 54 on the extremities 47*a*, 48*a*. Each rim 53, 54 can close approximately one third of the final side 30.

Two longitudinal ribs 51 and 52 flush with the shorter side 49 are each disposed at one extremity of each longer side 47, 48. The half-stud 46 is symmetrical about a plane parallel to the longer sides 47, 48 and equidistant between them. The longer side 47 is therefore set back relative to the rib 51 and the longer side 48 is likewise set back relative to the rib 52.

Hooks 10 and any other attachment means provided on the studs 1 can be provided on the longer sides 47, 48 and on the shorter side 49. The half-studs 46 are particularly useful for intersections of walls and for fixing to a fixed structure.

Intersections of walls can be achieved by installing a half-stud 46 with the final side 50 in contact with the panels of a first removable wall in accordance with the invention, in line with the intersection between two panels 55 and 56, the panel 55 being identical to the panel 22 and the panel 56 being of a slightly different type but having the same attachment means. The panels 55 and 56 are attached to a stud 1. A connecting member 57 can be disposed between the two panels 55 and 56 and attached in a hole 14 in the stud 1 behind the panels, on the one hand, and in a hole 11 in the half-stud 46, passing between the rims 53, 54 partly closing the final side 50, on the other hand. The connecting member 57 can be in the form of a rod with notches, not shown, adapted to cooperate with the edges of the holes 11 and 14 in the studs 46 and 1.

Elastic packing 58 between the studs 46 and 1 is made from an elastomer material, for example, or any other material having satisfactory elasticity and fire resistance properties. The elastic packing 58 has a C-shaped section with a main central branch 58*a* parallel to and in contact with the final side 50 of the half-stud 46 on one side and parallel to and in contact with the outside surface of the panels 55 and 56 on the other side, a lateral branch 58*b* parallel to and in contact with the longer side 47, and a lateral branch 58*c* parallel to an in contact with the longer side 48 of th half-stud 46. The lateral branches 58*b* and 58*c* are each gripped between the lateral branch 58*b*, 58*c* and the corresponding panel 22 and therefore replace the packing 21 used on the stud 1. The main central branch 58*a* incorporates a hole 58*d* in which the connecting member 57 is disposed. These two parts can be pre-assembled.

Panels, for example panels 22, can then be fixed to the hooks 10 of the half-stud 46 perpendicularly to the panels of the first wall.

For fixing the half-stud 46 to a fixed structure, its final side 50 can be brought into contact with said fixed structure and fixing means such as a coach screw passed through the hole 11 and screwed into the fixed structure to retain the rims 53, 54.

The invention provides a removable and reusable wall that is suitable for any type of premises, in particular tertiary premises, without any inconvenient limitation on height. The fact that the hooks are formed from the same material as the studs eliminates a large number of angle blocks or like parts and greatly reduces the number of components. Because the hooks are made without any additional material, the studs 1 are of reasonable weight, which facilitates handling them and reduces the loading on the floors on which they rest.

What is claimed is:

1. A removable wall system comprising: at least one panel and at least one panel fixing stud, said stud having a hollow section with a rectangular cross section defined at least in part by opposing longer and shorter sides of said stud and said stud comprising two pairs of symmetrical ribs disposed at the extremities of respective longer sides of said hollow section and extending parallel to the shorter sides of said hollow section, said removable wall system further comprising panel fixing means being formed integrally with the hollow section of the stud and comprising at least one hook formed in a first of said longer sides and being set back relative to the ribs.

2. A system according to claim 1 wherein the hook is formed in a metal plate of said first longer side.

3. A system according to claim 1 wherein the hook is formed as a cut-stamping in said first longer side.

4. A system according to any one of claim 1 wherein the hook projects from said first longer side.

5. A system according to claim 1 wherein said panel is fixed directly to the stud.

6. A system according to claim 1 wherein one of said longer sides of the stud is parallel to the outside surface of the panel.

7. A system according to claim 1 further comprising an insulating member which is in contact with a first shorter side of said stud.

8. A system according to claim 1 wherein said panel has an end part forming a lip parallel to said first longer side and cooperating with the fixing means.

9. A removable wall system comprising:

at least one panel and at least one panel fixing stud, the stud having a hollow section with a rectangular cross section, and said hollow section being defined at least in part by opposing longer sides and shorter sides of said stud, and wherein said stud has two symmetrical ribs each at one extremity of a respective one of said longer sides and each rib extending parallel to the shorter sides, said system further comprising at least one hook formed in a first of said longer sides, and the hook being set back relative to an adjacent rib.

10. A system according to claim 9 wherein the stud has a final side extending parallel to the shorter side and being at least partly defined by two rims each originating from one extremity of a respective one of said longer sides.

11. A system according to claim 9 further comprising a pair of hooks at a common height level along a direction of elongation of said stud.

12. A system according to claim 10 wherein said hook has a first hook section extending parallel with a plane extending parallel with the rectangular cross section and a second hook section extending perpendicular to said first hook section.

13. A system according to claim 12 wherein the second hook section has a curved free end.

14. A removable wall system comprising:

a panel;

a panel fixing stud having a hollow section of a rectangular cross section defined at least in part by longer and shorter sides of said panel fixing stud, and said panel fixing stud having two pairs of symmetrical ribs disposed at extremities of said longer sides and said two pairs of symmetrical ribs extending parallel to said shorter sides, the longer sides being set back relative to the symmetrical ribs, a panel fixing means being formed integrally with said hollow section comprising at least one hook being formed in a first said longer sides, said hook being set back relative to the ribs, and said panel fixing stud being symmetrical about a plane parallel to the longer side of the hollow rectangular cross section and about a plane parallel to the shorter side of the hollow rectangular cross section.

15. A system as recited in claim 14 wherein said panel fixing stud has a tubular H-shape profile in cross section.

16. A system as recited in claim 15 wherein the hook is formed as a cut-stamping within said first longer sides.

17. A system as recited in claim 14 further comprising an elastic packing positioned between said panel and said first long side.

18. A system as recited in claim 14 wherein there are a pair of hooks positioned at a common horizontal cross-sectional plane extending through a vertically oriented panel fixing stud.

19. A system as defined in claim 14 wherein the hook has an outer extremity set back relative to said ribs.

20. A system as defined in claim 4 further comprising a second panel fixing stud and an elastic member positioned between said at least one panel wherein the hook of said first panel fixing stud, and said second panel fixing stud.

* * * * *